United States Patent [19]

Teeslink

[11] 4,240,314

[45] Dec. 23, 1980

[54] CENTERING AND WEAR COMPENSATING MEANS FOR PUNCH PRESSES AND THE LIKE

[75] Inventor: John W. Teeslink, Clearfield, Utah

[73] Assignee: TLC Engineering, Inc., Layton, Utah

[21] Appl. No.: 50,145

[22] Filed: Jun. 19, 1979

[51] Int. Cl.[3] ..... B26F 1/14

[52] U.S. Cl. ..... 83/635; 83/169; 83/552; 83/698; 308/3 A; 308/4 R; 308/6 R

[58] Field of Search ..... 83/169, 552, 635, 698; 308/3 A, 4 R, 4 C, 6 R, 6 B

[56] References Cited

U.S. PATENT DOCUMENTS

| | | | |
|---|---|---|---|
| 3,449,991 | 6/1969 | Daniels | 83/552 X |
| 4,041,817 | 8/1977 | Nelson | 83/552 X |

*Primary Examiner*—J. M. Meister

*Attorney, Agent, or Firm*—Criddle & Western

[57] ABSTRACT

Centering and wear compensating means for turret bores and the like. Plugs of a suitable resilient, long wearing, self-lubricating material are equiangularly placed in bores of uniform length provided in the wall of a turret bore in which a tool holder is positioned. The plugs are made long enough to be compressed into the bores by the tool holder when the tool holder is centered in the turret bore and are spaced along the turret bore such that engagement of the plugs with the tool holder will be maintained as the tool holder is raised and lowered in the turret bore. The plugs are curved on one end to conform to the tool holder surface and are chamfered to permit easy compressibility as the tool holder is positioned in the turret bore.

7 Claims, 8 Drawing Figures

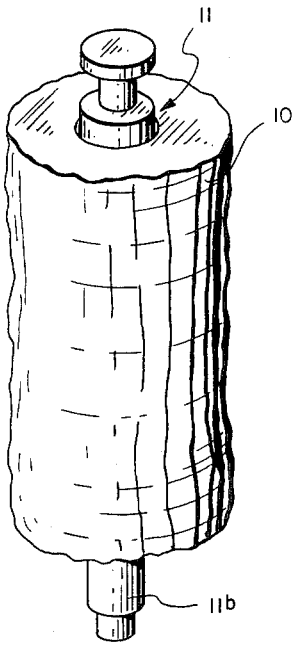
Fig. 1
Fig. 2
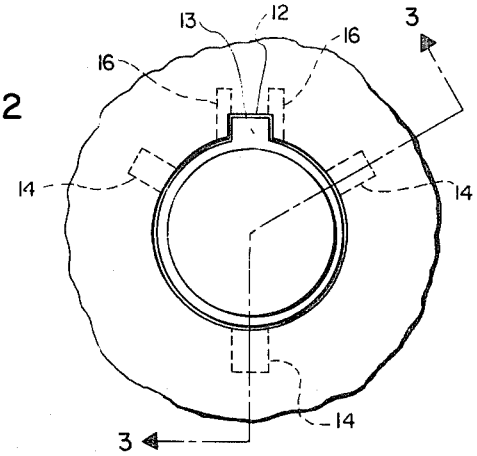
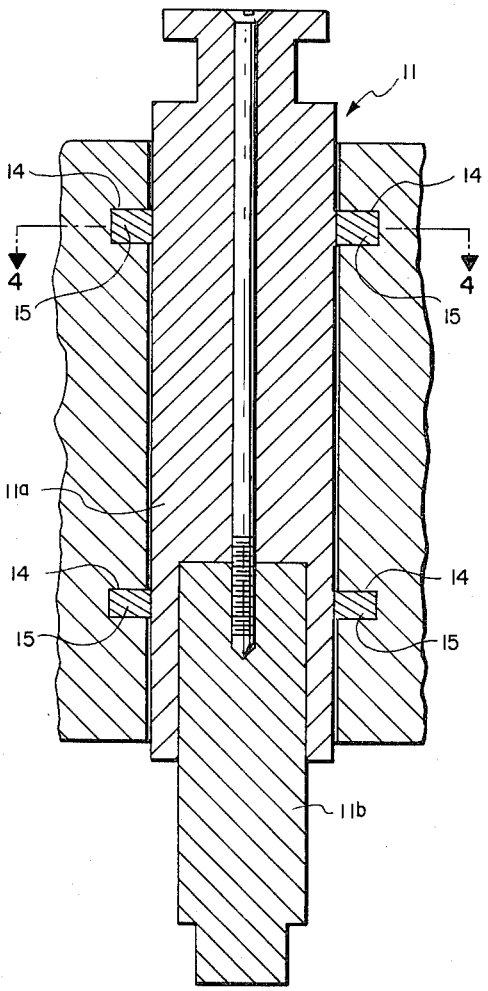
Fig. 3

CENTERING AND WEAR COMPENSATING MEANS FOR PUNCH PRESSES AND THE LIKE

BACKGROUND OF THE INVENTION

1. Field of the Invention

This invention relates to turret punches and the like and is particularly concerned with means for extending the usable life of the equipment.

2. Prior Art

A significant cost saving can be realized if the usuable life of the turret bores, tool holders, and tools of turret punches and the like can be extended at a reasonable cost. Since such tool holders generally wear within the turret bores in which they operate and then can no longer be properly centered within the cylinders, close punching tolerances cannot be maintained. In the past the repair of such a machine has usually involved taking the machine out of service, dismantling it, and replacing the turret and the plungers.

3. Objectives

A principal objective of the present invention is to provide centering and wear compensating means for punch presses and the like which greatly increases the useful life of the turret bores, the tool holders and the tools of such presses. In particular, it is an objective of the present invention to provide readily replaceable, wear compensating and centering inserts made of a resilient, long wearing, self-lubricating material which are positioned in the surface of the turret bore in which the tool holder operates, with the inserts being in sliding engagement with the tool holder.

SUMMARY OF THE INVENTION

In accordance with the present invention, improved centering and wear compensating means is provided for punch presses and the like which include a guide and support block or turret having a machined bore therethrough which is adapted to receive the elongate shaft or plunger portion of a tool holder in close tolerances for longitudinal, reciprocal movement therein. The improvement of the present invention comprises providing at least three equiangularly spaced wells or bores of uniform depth extending into the block or turret from the wall of the turret bore therein in a direction normal to the axis of the turret bore. Preferably, the wells are grouped into sets. Each set of wells comprising at least three wells of uniform depth equiangularly spaced around the circumference of the turret bore, with the center axes of the wells in each set all being in a common plane normal to the axis of the turret bore. In the preferred embodiment, at least two sets of the wells are provided, with the sets being spaced along the longitudinal length of the turret bore.

A plurality of plugs of a resilient, long wearing, self-lubricating material are placed lengthwise into the wells, respectively. The plugs have a length somewhat greater than the depth of the wells, so that the plugs are compressed into the respective wells by the shaft of the tool holder when the shaft is centered in the turret bore of the block or turret, with the plugs being maintained in compressed, sliding engagement with the surface of the shaft as the shaft moves back and forth in the turret bore of the block.

The plugs maintain the shaft of the tool holder in centered position within the turret bore of the block or turret with minimal wear occurring at the surface of either the shaft of the tool holder or the wall of the turret bore. As the plugs wear to a point where the shaft of the tool holder begins to make contact with the turret bore in the block or turret, the plugs are easily, readily, and inexpensively replaced, and the usable life of the tool holder, the tool, and the block or turret is increased significantly.

Additional objects and features of the invention will become apparent from the following detailed description of a preferred embodiment taken in conjunction with the accompanying drawings in which:

FIG. 1 is a fragmentary pictorial view of a portion of a guide and support block or turret, showing a typical turret bore therein, with a tool holder positioned within the turret bore;

FIG. 2 is a top plan view of the turret portion and tool holder of FIG. 1;

FIG. 3 is a vertical cross-sectional of the turret portion and tool of FIG. 2 taken along line 3—3 of FIG. 2;

DETAILED DESCRIPTION OF THE ILLUSTRATED EMBODIMENT

Figure 5:
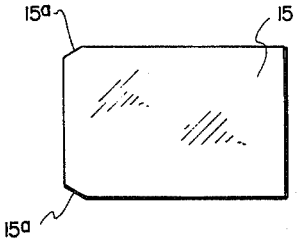
FIG. 5 is an enlarged vertical elevation of a typical plug bearing member in accordance with the invention.

Referring to the drawings, a fragmentary portion of a turret 10 is illustrated showing a typical turret bore therein, with an associated tool holder 11 positioned in the turret bore. The tool holder 11 associated with the turret 10 has an elongate shaft portion 11*a* which is adapted to be received in a longitudinal turret bore extending through the turret 10. The lower end of the tool holder 11 has a tool 11*b* removably attached thereto. The tool 11*b* is adapted for punching operations requiring close tolerances.

The shaft portion 11*a* and the bore of the turret 10 are machined to close tolerances, with the clearance on all sides of the shaft 11*a* and the bore of turret 10 being from about 0.001 to about 0.015 inch when the shaft 11*a* is centered in the bore. The shaft 11*a* is adapted to move back and forth longitudinally in the turret bore of the turret 10. When the turret 10 is attached to a press punch, the end of the tool 11 opposite the end to which the removable tool 11*b* is attached is engaged by a cam or other means for imparting reciprocal movement to the tool holder 11.

The turret bore of the turret 10 can be provided with an elongate slot in the form of a keyway 12 (FIGS. 2, 4 and 8) along the longitudinal length of the wall of the turret bore. The shaft of the tool holder 11 is, in turn, provided with an elongate protrusion in the form of a key 13 which is adapted to engage the keyway 12 in the turret 10. Clearances between the key and keyway are generally the same as those given hereinbefore with respect to the shaft 11*a* of the tool holder 11 and the turret bore of the turret 10.

The mechanism heretofore described, including the turret 10, tool holder 11, keyway 12, and key 13 are well known in the machine art and do not, per se, constitute part of the present invention. In accordance with the present invention, improved centering and wear compensating means are provided for achieving significantly increased useful life of the turret bore, the tool holder 11, the tool 11*b*, and the die (not shown) which receives the tool.

At least three equiangularly spaced wells 14 of uniform depth are provided in the wall of the turret bore in turret 10. The wells 14 extend into the turret 10 from the wall of the turret bore therein in a direction substantially normal to the axis of the turret bore. As illustrated, there are preferably at least two sets of wells 14, with each set containing at least three equiangularly spaced wells, with the sets of wells 14 being spaced along the longitudinal length of the turret bore in the turret 10. As illustrated, the sets of wells 14 are positioned near the opposite ends of the turret bore in turret 10. Generally, the shaft of tool 11*b* is smaller in diameter than the shaft 11*a* of the tool holder 11, and during normal upward travel of the tool holder 11, the shaft of tool 11*b* enters the lower end portion of the turret bore in the turret 10. In such circumstances, the set of wells 14 adjacent that end of the turret 10 is spaced inwardly from that end of the turret 10 just beyond the point of maximum inward travel of the tool 11*b*. The wells 14 in each set are advantageously centered on a circumference of the turret bore which lies in a plane normal to the longitudinal axis of the turret bore. However, the wells 14 need not necessarily be aligned on a common cross-sectional plane through the turret bore, and it is conceivable that the wells in each set could be spaced longitudinally along the length of the turret bore such that the loci of the centers of the wells 14 of the two sets of wells form a spiral along the length of the wall of the turret bore.

Figure 6:
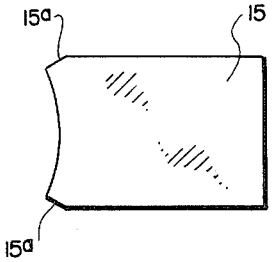
FIG. 6 is an enlarged top plan of the plug bearing member of FIG. 5.
Figure 7:
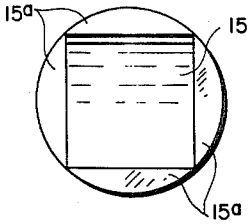
FIG. 7 is an enlarged end view of the plug bearing member of FIG. 5 showing the end thereof which contacts the shaft of the tool holder.

Wear plugs 15 of a resilient, long wearing, self-lubricating material are positioned lengthwise into the wells 14, respectively. The plugs 15 are preferably made of polymeric tetrafluoroethylene or formaldehyde polymers, such as those sold under the tradenames Teflon and Delrin, respectively. The plugs 15 have a length greater than the depth of the wells 14, so that the plugs are compressed into their respective wells 14 by the shaft 11*a* of the tool holder 11 when the shaft 11*a* is centered in the turret bore of turret 10. Typically, the length of the plug 15 is from about 1/16 to about ⅛ inch greater than the depth of the wells 14. The ends of the plugs 15 which contact the surface of the shaft 11*a* preferably have curved end faces as shown in FIG. 6 which conform to the surface of the shaft 11*a*. These ends may also be chamfered as shown by reference numerals 15*a* in FIGS. 5, 6 and 7. The chamfers 15*a* enhance the compression of the plugs 15 as the tool holder is positioned within the turret bore of the turret 10. The depth of the chamfer is preferably at least as great as the difference between the length of the plugs 15 and the depth of the wells 14.

When the shaft 11*a* is positioned in the bore of turret 10, the plugs 15 are maintained in compressed, sliding engagement with the surface of the shaft 11*a* as it reciproates in the turret bore of the turret 10. The wear plugs 15 maintain the shaft 11*a* in centered position within the bore of the turret 10, and frictional contact between the shaft 11*a* and the wall of the bore is essentially eliminated. Frictional wear due to sliding contact between the shaft 11*a* and the plugs 15 occurs slowly and gradually on the plugs 15, and, ultimately, replacement of the plugs is required. However, replacement of the plugs 15 is far less costly and time consuming than dismantling the punch press or other piece of equipment to repair or replace the tool holder 11 and turret 10 as has been the practice heretofor.

Figure 4:
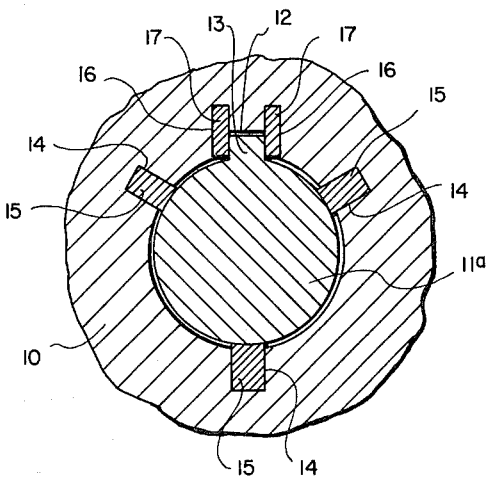
FIG. 4 is a horizontal cross-section through the turret portion and tool holder of FIG. 2 as taken along the line 4—4 of FIG. 2.
Figure 8:
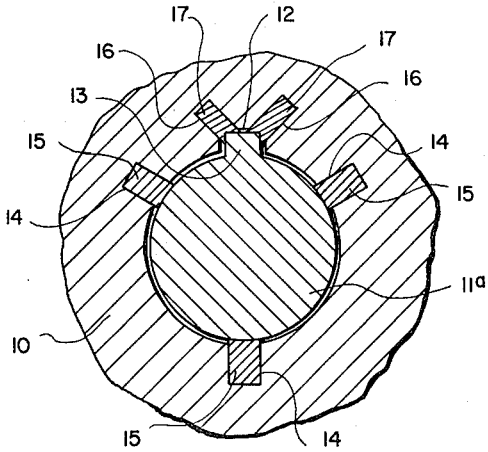
FIG. 8 is a horizontal cross-section similar to that of FIG. 4 showing alternative positioning of the plug bearing members which contact the key on the tool holder.

When the shaft 11*a* of the tool is provided with a key 13 which is received in a keyway 12 along the turret bore of turret 10, it has been found advantageous to provide additional wells 16 of uniform depth extending inwardly from the keyway 12. The wells 16 can extend inwardly parallel to the flat sides of the keyway 12 as shown in FIG. 4, or the wells 16 can extend diagonally from the corners of the keyway 12 as shown in FIG. 8.

Additional plugs 17 made of the same material as plugs 15 are inserted lengthwise into the wells 16 to guide the key 13 in sliding movement along the keyway 12 and to prevent any rotational movement of the tool holder 11 as it moves in the turret bore. The wells 16 are positioned in the turret 10 so that the plugs 17 situated therein make sliding contact with the opposite sides of the key 13. When the wells 16 extend parallel to the flat sides of the keyway 12, the exposed side of the wear plugs 17 make sliding contact with the corresponding flat sides of the key 13 as shown in FIG. 4. In those instances wherein it is difficult to machine the parallel wells 16 due to the restrictive size of the turret bore, an alternate positioning of the wells 16 is utilized as shown in FIG. 8. In the alternate positioning, the wells 16 extend inwardly into the turret diagonally from the corners of the keyway 12. The ends of the plugs 17 installed in the diagonal wells 16 contact the opposite corners of the key 13. These plugs have a right angle slot in their ends for engaging the corners of the key 13. The plugs 17 are so sized that when the tool holder 11 is centered in the turret bore, the key 13 thereon compresses the plugs 17 into the wells 16, and as the tool holder 11 moves back and forth in the turret bore, the key 13 makes sliding engagement with the plugs 17 thereby preventing any rotational motion of the tool holder 11. One set of wells 16 and plugs 17 have been found to adequately prevent rotational movement of the tool holder, and thereby eliminate excessive wear between the key 13 and keyway 12. The set of wells 16 and plugs 17 can be positioned anywhere along the keyway 12 such that the key 13 makes sliding contact therewith during the reciprocating motion of the tool holder 11. If so desired, two or more sets of wells 16 and plugs 17 can be provided at spaced positions along the keyway 12.

It is to be understood that the present disclosure, including the detailed description of a preferred embodiment of the invention, is made by way of example and that various other embodiments are possible without departing from the subject matter coming within the scope of the following claims, which subject matter is regarded as the invention.

I claim:

1. An improvement in punch presses and the like, including a turret having at least one machined bore therethrough adapted to receive the elongate shaft portion of a tool holder in close tolerances therein for longitudinal reciprocal movement of said shaft in said bore, the improvement, whereby the usable life of the turret bore, tool holder, tool and die of such press is significantly increased, comprising providing at least three equiangularly spaced wells of uniform depth extending into said turret from the wall of the bore therein in a direction substantially normal to the axis of said bore;

positioning plugs of a resilient, long wearing, self-lubricating material, lengthwise into said wells, respectively, said plugs having a length greater than the depth of said wells, so that the plugs are compressed into the respective wells by the shaft of said tool holder when said shaft is centered in said bore, with said plugs being maintained in compressed, sliding engagement with the surface of said shaft as said shaft reciprocates in said bore.

2. The improvement in punch presses in accordance with claim 1, wherein the ends of said plugs which engage said shaft have curved faces to conform to the surface of said shaft.

3. The improvement in punch presses in accordance with claim 2, wherein the edges at the ends of said plugs which engage said shaft are chamfered to enhance compression of the plugs into the respective wells of said bore as the shaft of the tool is positioned in said bore.

4. The improvement in punch presses in accordance with claim 1, wherein the plug is made of formaldehyde polymeric material.

5. The improvement in punch presses in accordance with claim 1, wherein the plug is made of tetrafluoroethylene polymeric material.

6. The improvement in punch presses in accordance with claim 1, wherein at least two sets of wells are provided, each set containing at least three equiangularly spaced wells, with the sets of wells being spaced along the longitudinal length of the bore in said turret.

7. The improvement in punch presses in accordance with claim 1, wherein an elongate, slot in the form of a keyway is formed in the turret along the longitudinal length of the wall of said bore, and the shaft of said tool holder has an elongate protrusion in the form of a key which is adapted to engage the keyway in said turret, said tool holder further including at least one pair of wells in addition to the equiangularly spaced wells, with said one pair of wells extending from the keyway into said block, and plugs of resilient, long wearing, self-lubricating material so that the plugs in said one pair of wells are maintained in compressed, sliding engagement with the opposite side surfaces, respectively of said key as the shaft reciprocates in said bore.

* * * * *